United States Patent [19]

Baker et al.

[11] Patent Number: 4,624,268

[45] Date of Patent: Nov. 25, 1986

[54] SMOKING ARTICLES

[75] Inventors: Richard R. Baker, Southampton; Frederick J. Dashley, New Milton; Anthony D. McCormack, Bournemouth; Colin C. Greig, Salisbury, all of England

[73] Assignee: British-American Tobacco Company Limited, London, England

[21] Appl. No.: 606,360

[22] Filed: May 2, 1984

[30] Foreign Application Priority Data

May 17, 1983 [GB] United Kingdom ..... 8313604

[51] Int. Cl.[4] ..... A24D 1/02

[52] U.S. Cl. ..... 131/332; 131/365

[58] Field of Search ..... 131/332, 365, 331

[56] References Cited

U.S. PATENT DOCUMENTS

| | | | |
|---|---|---|---|
| 3,744,496 | 7/1973 | McCarty et al. | 131/365 |
| 4,231,377 | 11/1980 | Cline et al. | 131/365 |
| 4,407,308 | 10/1983 | Baker et al. | 131/365 |
| 4,420,002 | 12/1983 | Cline | 131/365 |
| 4,433,697 | 2/1984 | Cline et al. | 131/365 |
| 4,450,847 | 5/1984 | Owens | 131/365 |
| 4,461,311 | 7/1984 | Mathews et al. | 131/365 |

*Primary Examiner*—V. Millin
*Assistant Examiner*—H. Macey
*Attorney, Agent, or Firm*—Kane, Dalsimer, Kane, Sullivan and Kurucz

[57] ABSTRACT

A smoking article such as a cigarette comprising a smoking-material rod enwrapped in a wrapper paper with an inherent air permeability of 3 to 45 Coresta units and comprising at least one hydroxide compound and at least one organic compound of the group comprising lithium hydroxide, aluminum hydroxide, calcium hydroxide, potassium formate, sodium formate and sodium acetate, at a total loading level of the compounds of not less than two g/m$^2$ whereby the total particulate matter (TPM) in the side-stream-smoke emanating from the lit end of said article during the smoking thereof is reduced by at least 30% in relation to the TPM which emanates from the lit end of an otherwise identical smoking article comprising conventional wrapper paper and smoked under the same smoking conditions.

12 Claims, No Drawings

SMOKING ARTICLES

BACKGROUND OF THE INVENTION

1. Field of the Invention

This invention relates to wrapped smoking articles, particularly cigarettes.

2. Brief Description of the Prior Art

Various proposals have been made for cigarettes which, when smoked, emit reduced amounts of side-stream-smoke constituents, sidestream smoke being the smoke which emanates from the lit end of the cigarette. Thus, for example, in United Kingdom Patent Specification No. 2,094,130A there is disclosed a cigarette of reduced sidestream emission which comprises a rod of smoking material wrapped in a cigarette paper of which the air permeability due to viscous flow is not more than about 3 CORESTA units and of which the ratio of the coefficient of diffusion of oxygen through nitrogen in the paper to the thickness of the paper is in the range of 0.08 to 0.65 cm $sec^{-1}$.

In U.S. Pat. No. 4,231,377, it is proposed to reduce sidestream smoke by incorporating a combination of magnesium oxide and an adjuvant salt in cigarette paper.

Conventional cigarette paper comprises cellulose fibres and an inorganic filler, most commonly chalk. A burn-controlling compound is also often included.

The present invention provides a cigarette or the like of which the smoking-material rod is enwrapped in a cigarette paper comprising one or more compounds of the group comprising lithium hydroxide, aluminium hydroxide, calcium hydroxide, potassium formate, sodium formate and sodium acetate, whereby the total particulate matter in the sidestream smoke emanating from the lit end of said cigarette during the smoking thereof can be reduced by at least 30% compared with that which emanates from the lit end of a comparable cigarette, smoked under comparable smoking conditions, comprising conventional cigarette paper.

SUMMARY OF THE INVENTION

In a smoking article such as a cigarette comprising a smoking-material rod enwrapped in a wrapper paper comprising at least one compound of the group or a plurality of such compounds comprising lithium hydroxide, aluminum hydroxide, calcium hydroxide, potassium formate, sodium formate and sodium acetate, the loading level of the compound or total loading level of the compounds is not less than two $g/m^2$ and the total particulate matter (TPM) in the side-stream-smoke emanating from the lit end of said article during the smoking thereof being reduced by at least 30% in relation to the TPM which emanates from the lit end of an otherwise identical smoking article comprising conventional wrapper paper and smoked under the same smoking conditions. Advantageously the reduction in sidestream TPM is at least 50%.

The inherent air permeability of the wrapper paper is within a range of 3 to 45 Coresta units or, preferably, within a range of 3 to 20 of said units, or even 3 to 10 such units. With advantage the wrapper paper may comprise at least one or two hydroxide compounds and/or at least one or two organic compounds of said group. Suitably, the loading level of any one of the organic compounds will not exceed three $g/m^2$ and the loading level of any one of the hydroxide compounds will be at least two $g/m^2$. The rate of production of sidestream TPM does not exceed about two mg $min^{-1}$. The wrapper paper may comprise calcium hydroxide.

The invention may reside in a wrapper paper comprising at least one compound of the group comprising lithium hydroxide, aluminum hydroxide, calcium hydroxide, potassium formate, sodium formate and sodium acetate at a loading level of the compound, or a total loading level of the compounds, of not less than two $g/m^2$. The invention may also reside in cigarette paper, treated as described in any of Examples 1–5.

DETAILED DESCRIPTION OF THE INVENTION

The inherent air permeability of the paper, i.e. that due to viscous flow, should in a range of 3 to 45 CORESTA units but preferably within a range of 3 to 20 CORESTA units and more preferably within a range of 3 to 10 CORESTA units. The air permeability of a paper as expressed in CORESTA units is the amount of air in cubic centimeters which passes through one square centimeter of the paper in one minute at a constant pressure difference of 1.0 kilopascal. For details as to the concept of viscous flow in relation to cigarette-paper permeability, reference is made to the aforesaid Specification No. 2,094,130A.

Preferably, the cigarette paper comprises a plurality of compounds of said group, advantageously at least three.

The present invention also provides smoking-article wrapper paper comprising one or more compounds of the group comprising lithium hydroxide, aluminium hydroxide, calcium hydroxide, potassium formate, sodium formate and sodium acetate.

The invention further provides features of method of production of cigarette paper, cigarettes and/or smoking-material rod substantially as hereinafter described in the accompanying Specification, and/or the appended Experiments.

The or each component may be applied, together with a suitable binder or solvent, as a coating on the cigarette paper to either one or the other side thereof. Alternatively, it may be included in the paper at the papermaking stage. The compound(s) and loading level thereof are preferably selected so as to result in a reduction in sidestream smoke-total particulate matter (TPM) of at least 50% and preferably at least 60%.

The rate of production of sidestream TPM, i.e. the sidestream TPM delivery per cigarette divided by the time over which the cigarette is smoked, correlates with the amount of visible sidestream smoke which is observed issuing from the cigarette. By use of the present invention, it is possible to achieve rates of production of sidestream TPM considerably less than the typical value of three mg $min^{-1}$ encountered with conventional cigarettes. Advantageously, the rate of sidestream TPM should be less than two mg $min^{-1}$ when measured according to a procedure described for Experiment 1 hereinbelow.

Some of the compounds which in accordance with the present invention bring about a reduction in sidestream smoke TPM exhibit adverse properties if they are present at too high a loading level. Thus, for example, lithium hydroxide can cause a breakdown of the paper structure and therefore the loading level of this compound should be limited to a level below which this breakdown phenomenon does not occur. A loading level limit should also be observed for potassium formate, because higher loading levels have been found to result in an unacceptable, coke-like ash formation in the smoking of test cigarettes. An advantage of using a plurality, especially three or more, sidestream-smoke reducing compounds is that a requisite total loading level can be obtained without exceeding an upper loading level limit of any one of the compounds.

Suitably, of the above-mentioned compounds, the wrapper paper comprises at least calcium hydroxide.

It was determined by smoking test cigarettes that no reduction, or only a negligible reduction, in visible sidestream smoke resulted from using cigarette papers treated respectively with magnesium oxide, calcium carbonate, lithium carbonate, potassium sodium tartrate, aliminium ammonium sulphate, magnesium citrate, magnesium oxalate, triammonium citrate, citric acid and heavy magnesium carbonate.

Examples of the invention will now be further described, by way of example, by reference to a number of experiments.

EXPERIMENT 1

Plain, 70 mm long cigarettes were made using a flue-cured tobacco and a single-layer wrapper of cigarette paper having an initial air permeability of 26 CORESTA units and a weight of 23 g/m$^2$. The cigarette paper had, before cigarette manufacture, been coated, on the side intended to be the inner side in the manufactured cigarettes, with a coating comprised of starch (6%), aluminium hydroxide (12%), magnesium hydroxide (12%), calcium hydroxide (12%), sodium formate (3%) and sodium acetate (3%). The percentage figures are the loading levels for the respective compounds based on the weight of the coated paper. Thus the total coating level was 48%, that is 21.2 g/m$^2$. The starch was used as a binder. The air permeability of the coated paper was 22 CORESTA units.

Each of these cigarettes was smoked under standard smoking conditions, i.e. a 35 cc.puff of 2 seconds duration every minute, while extending into a vertical flask through an aperture in the wall thereof which was fitted with a cigarette contacting seal. Across the upper opening of the flask was fitted an 82 mm diameter Cambridge filter pad. Air and sidestream smoke were drawn upwardly under the action of an air pump, the flow of air into a lower opening of the flask, which flow was induced by the pump, being maintained at 1 liter/minute. The sidestream smoke TPM was collected on the filter pad.

By weighing the filter pad before the commencement of the smoking of a cigarette and after the completion of the smoking cycle, a determination was made for each cigarette of the total amount of sidestream-smoke TPM emitted by the cigarette. It was found that the total was on average 14.1 mg.

When control cigarettes, having uncoated cigarette paper, were smoked in the same manner, it was found that the total sidestream-smoke TPM was 23.2 mg. Thus the application to the cigarette paper of the test cigarettes of the above detailed coating brought about a 39% reduction in sidestream-smoke TPM.

EXPERIMENT 2

The procedure of Experiment 1 was followed except that the coating applied to the cigarette paper comprised starch (9%), aluminium hydroxide (18%), calcium hydroxide (18%), sodium formate (2.7%) and sodium acetate (2.7%). Thus the loading level, excluding the starch, was 17.3 g/m$^2$. The air permeability of the paper after the coating had been applied was 18 CORESTA units. The total sidestream smoke TPM for uncoated control cigarettes was 23.9 mg, whereas that for the test cigarettes was 13.9 mg. Therefore the coating brought about a 42% reduction.

EXPERIMENT 3

The procedure for Experiment 1 was followed except that the coating comprised starch (9%), calcium hydroxide (35%), sodium formate (2.8%) and sodium acetate (2.8%), giving a loading level, excluding starch, of 15.7 g/m$^2$. The total sidestream-smoke TPM was reduced from 27.0 mg for control cigarettes to 14.5 mg for the test cigarettes, this representing a 46% reduction. Experiment 3 shows the ability of calcium hydroxide to effect a good sidestream reduction when it predominates in a coating mixture.

EXPERIMENT 4

The procedure of Experiment 1 was followed except that the coating comprised starch (8%). aluminium hydroxide (16%), magnesium hydroxide (16%) and calcium hydroxide (16%), giving a loading level, excluding starch, of 21.2 g/m$^2$. The coating reduced the air permeability of the paper to 10 CORESTA units. Total sidestream-smoke TPM for control cigarettes was found to be 25.8 mg and for the test cigarettes 16.9 mg, this representing a reduction of 34%.

EXPERIMENT 5

The procedure of Experiment 1 was again repeated except that a cigarette paper was used which had an initial air permeability of 5.2 CORESTA units and that the coating comprised only sodium formate (5%) and sodium acetate (5%), giving a loading level of 2.6 g/m$^2$. The air permeability of the paper after coating was 5.1 CORESTA units. Total sidestream-smoke TPM was found to be 28.8 mg for control cigarettes having the same cigarette paper as for the control cigarettes of Experiment 1 and 19.8 mg for the present test cigarettes, this representing a reduction of 31%. This experiment shows that, by use of a comparatively low level (10%) of loading of sidestream-reducing compounds in combination with the use of a low permeability paper, a significant reduction in sidestream TPM is obtained. The rate of production of sidestream-TPM for the test cigarettes was 2.0 mg min$^{-1}$.

What is claimed is:

1. A smoking article comprising a smoking-material rod enwrapped in a wrapper paper comprising at least one hydroxide compound and at least one organic compound of the group consisting of lithium hydroxide, aluminum hydroxide, calcium hydroxide, potassium formate, sodium formate and sodium acetate, at a total loading level of the compounds of not less than two g/m$^2$, whereby the total particulate matter (TPM) in the sidestream-smoke emanating from the lit end of said article during the smoking thereof is reduced by at least 30% in relation to the TPM which emanates from the lit end of an otherwise identical smoking article comprising conventional wrapper paper and smoked under the same smoking conditions.

2. A smoking article according to claim 1, the said reduction in sidestream TPM being at least 40%.

3. A smoking article according to claim 1, wherein the inherent air permeability of said wrapper paper is within a range of 3 to 45 Coresta units.

4. A smoking article according to claim 3, wherein said permeability of said wrapper is within a range of 3 to 20 Coresta units.

5. A smoking article according to claim 3, wherein said permeability of said wrapper is within a range of 3 to 10 Coresta units.

6. A smoking article according to claim 1, wherein said wrapper paper comprises three or more of said compounds of said group.

7. A smoking article according to claim 1, wherein said wrapper paper comprises at least two organic compounds of said group.

8. A smoking article according to claim 1, wherein the loading level of an organic compound of said group does not exceed three $g/m^2$.

9. A smoking article according to claim 1, wherein the loading level of hydroxide compound of said group is at least two $g/m^2$.

10. A smoking article as claimed in claim 1, wherein the rate of production of sidestream TPM does not exceed two mg $min^{-1}$.

11. A smoking article according to claim 1, wherein said wrapper paper comprises calcium hydroxide.

12. A smoking article wrapper paper comprising at least one hydroxide compound and at least one organic compound of the group consisting of lithium hydroxide, aluminum hydroxide, calcium hydroxide, potassium formate, sodium formate and sodium acetate, at a total loading level of the compounds, of not less than two $g/m^2$, whereby the total particulate matter (TPM) in the sidestream-smoke emanating from the lit end of said article during the smoking thereof is reduced by at least 30% in relation to the TPM which emanates from the lit end of an otherwise identical smoking article comprising conventional wrapper paper and smoked under the same smoking conditions.

* * * * *